US005727121A

United States Patent [19]

Chiba et al.

[11] Patent Number: 5,727,121

[45] Date of Patent: Mar. 10, 1998

[54] SOUND PROCESSING APPARATUS CAPABLE OF CORRECT AND EFFICIENT EXTRACTION OF SIGNIFICANT SECTION DATA

[75] Inventors: Takeshi Chiba; Koh Kamizawa, both of Kanagawa, Japan

[73] Assignee: Fuji Xerox Co., Ltd., Tokyo, Japan

[21] Appl. No.: 382,786

[22] Filed: Feb. 2, 1995

[30] Foreign Application Priority Data

Feb. 10, 1994 [JP] Japan ..... 6-036347

[51] Int. Cl.[6] ..... G10L 9/04

[52] U.S. Cl. ..... 395/2.23; 395/2.24; 395/2.17; 395/2.19; 395/2.42

[58] Field of Search ..... 395/2, 2.1, 2.17, 395/2.19, 2.23, 2.24, 2.35, 2.36, 2.37, 2.4, 2.42, 2.55, 2.57, 2.6, 2.62; 381/41, 42, 43, 46, 47

[56] References Cited

U.S. PATENT DOCUMENTS

| | | | |
|---|---|---|---|
| 4,532,648 | 7/1985 | Noso et al. | 395/2.62 |
| 4,718,097 | 1/1988 | Uenoyama | 395/2.19 |
| 4,769,844 | 9/1988 | Fujimoto et al. | 395/2.62 |
| 4,881,266 | 11/1989 | Nitta et al. | 395/2.62 |
| 4,926,484 | 5/1990 | Nakano | 395/2.23 |

FOREIGN PATENT DOCUMENTS 63-30645 6/1988 Japan .

OTHER PUBLICATIONS

S.K. Das et al., "Automatic Utterance Isolation Using Normalized Energy," IBM Technical Disclosure 20(5):2081–2084, Oct. 1977.

Parsons, Voice and Speech Processing, 1987, pp. 295–297.

Furui, Digital Speech Processing, Synthesis, and Recognition, 1989, pp. 229–230.

Rowden, Speech Processing, 1992, pp. 266–267.

"Voice Processing and DSP", Y. Arai et al., Keigaku Shuppan Co., pp. 212–214 (1989).

"Digital Voice Processing", S. Furui, Tokai University Publication Center, pp. 10–11 and 18, (1985).

*Primary Examiner*—Allen R. MacDonald
*Assistant Examiner*—Vijay B. Chawan
*Attorney, Agent, or Firm*—Finnegan, Henderson, Farabow, Garrett & Dunner, L.L.P.

[57] ABSTRACT

Input sound information is converted to digital sound data, and characteristic parameter values are extracted from the digital sound data. Based on the characteristic parameter values, a judging unit produces a judgement result indicating whether the current section is a significant or insignificant section and its continuation length. If the continuation length is shorter than the predetermined length, a correcting unit reverses the judgment of whether the current section is a significant or insignificant section and sums up the continuation length of the current section and continuation lengths of the adjacent sections, to thereby produce a single section data.

5 Claims, 6 Drawing Sheets

SOUND PROCESSING APPARATUS CAPABLE OF CORRECT AND EFFICIENT EXTRACTION OF SIGNIFICANT SECTION DATA

BACKGROUND OF THE INVENTION

The present invention relates to a sound processing apparatus and, more specifically, to a sound processing apparatus which can extract desired data portions from a sound signal efficiently and correctly in processing the sound signal after converting it to digital sound data.

In recent years, a technology of electronically dealing with sound and performing data processing on a resulting sound signal has developed in a variety of manners and are introduced or discussed in, for instance, documents [1]–[3] listed below:

Document [1]: Yasuhiko Arai and Masami Osaki, "Voice Processing and DSP" (in Japanese), Keigaku Shuppan Co., Ltd., May 31, 1989 (first print).

Document [2]: Sadaoki Furui, "Digital Voice Processing" (in Japanese), Tokai University Publication Center, Sep. 25, 1985 (first print).

Document [3]: Japanese Examined Patent Publication No. Sho. 63-30645

In document [3] entitled "Information Processing System," proposes an information processing system for processing a document including voice components and text components. In this system, on a display device, display of voice components indicates their relative positional relationship with respect to text components. Therefore, it is possible to edit both of the voice components and the text components by placing a cursor in those components being displayed and giving an edit instruction.

A specific description will be made of a conventional sound processing apparatus. First, its configuration will be described. FIG. 5 is a block diagram showing an example of a conventional sound processing apparatus. In FIG. 5, input sound information 501 is converted to an input analog sound signal 503 by a microphone 502. The input analog sound signal 503 is converted to input digital sound data 505 by an analog-to-digital converter (hereinafter referred to as "A/D converter") 504. The input digital sound data 505 is analyzed by an analyzing unit 506, so that values of a prescribed characteristic parameter 507 is extracted. The extracted characteristic parameter 507 of the sound signal is input to a judging unit 508. The judging unit 508 judges, based on the characteristic parameter, whether the input sound information is significant or not, and outputs a judgment result 509. Based on the judgment result 509, a sound data processing unit 512 processes the input digital sound data 505 for a significant section, and outputs processed output digital sound data 513.

In the above sound processing apparatus, a procedure generally employed by the judging unit 508 to judge for significant sections from the characteristic parameter 507 of the sound signal is to use, for instance, sound waveform information such as amplitude or power as the characteristic parameter. As for the procedure of judging for significant sections, document [1] has a passage "There are two schemes of a voice detector, i.e., signal power detection and signal spectrum analysis and judgment. Further, there exist schemes in which the above two schemes are compounded or caused to operate adaptively in accordance with an input signal." As indicated in this passage, sound waveform information such as amplitude or power is used as the characteristic parameter in the voice detection for a control purpose.

In the example of the sound processing apparatus shown in FIG. 5, the characteristic parameter 507 obtained by the analysis in the analyzing unit 506 is an amplitude or power. To judge for significant sections from the characteristic parameter, the judging unit 508 compares the characteristic parameter 507 with a predetermined value Vth. A judgment formula is as follows:

"If (value of input characteristic parameter) > *Vth*,
Then (significant)
Else (insignificant)"

The sound data processing unit 512 outputs the processed output digital sound data only when the judgment result 509 of the judging unit 508 is "significant."

By the way, among voice portions of sound data, voiceless consonant or assimilated sound portions have an extremely small amplitude when their signal waveforms are observed. It is known that the amplitude dynamic range of an actually observed sound signal waveform may exceed 30 dB.

Therefore, the conventional sound processing apparatus, for instance, the one shown in FIG. 5 has a problem that a signal section with a small amplitude such as a voiceless consonant or assimilated sound portion is judged as a voiceless section, i.e., an insignificant section. And there may occur breaks in a voice section of sound data, such as a sentence or phrase, which section is essentially a single logical block. It is therefore difficult to extract, with high accuracy, sections of significant blocks from voice portions of sound data.

SUMMARY OF THE INVENTION

The present invention has been made to solve the above problems, and has an object of providing a sound processing apparatus which can extract, efficiently and correctly, data of sections of desired significant blocks from a sound signal in converting the sound signal to digital sound data and processing the digital sound data thus obtained.

In the following description, sections to be extracted are referred to as extracting sections or significant sections, and sections other than those sections are referred to as non-extracting sections or insignificant sections.

According to the invention, a sound processing apparatus comprises:

means for inputting a sound signal;

means for converting the input sound signal to digital sound data;

means for extracting characteristic parameter values from the digital sound data;

means for judging for a significant section and an insignificant section of the input sound signal from the extracted characteristic parameter values, and producing a judgment result indicating whether a current section is the significant or insignificant section; and means for correcting the judgment result in accordance with a length of the significant or insignificant section.

With the above constitution, in processing a sound signal after converting it to digital sound data, it becomes possible to correctly extract sound data from the sound signal with each significant block as a single section. Therefore, section data of a significant block can be processed as single data, and the entire sound signal processing can be performed efficiently. A description will be made by using specific values. For example, in the case of Japanese speeches, a consonant portion has a period of 5–130 ms, and even a syllable consisting of a consonant and a vowel has a period of 200 ms at the maximum. Since a sentence or phrase consists of a plurality of syllables, a sound data section corresponding to a sentence or phrase is longer than that corresponding to a consonant. That is, a sentence or phrase is not contained in a section whose period is shorter than 130 ms. Therefore, even if certain section data is judged, at first, as an insignificant section, it is later corrected to a significant section.

In the sound processing apparatus of the invention, the continuation length of a significant or insignificant section is detected, and the detected continuation length is compared with a predetermined value, to correct the judgment result. This type of correction allows a sound data section as represented by a sentence or phrase, which should be regarded as a single logical block, to be extracted from sound data as a single, corresponding section without losing necessary information. As a result, it becomes possible to efficiently edit or use sound information.

DESCRIPTION OF THE PREFERRED EMBODIMENTS

Figure 1:
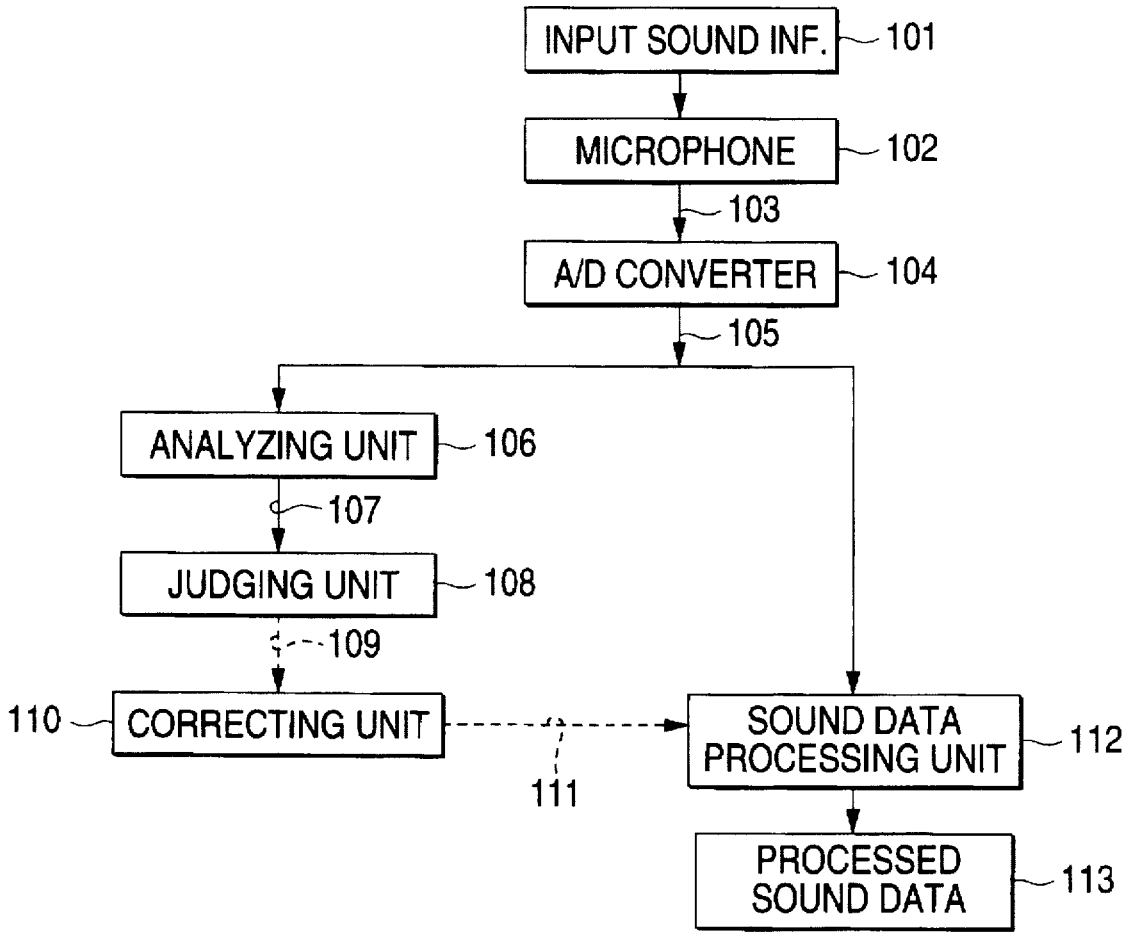
FIG. 1 is a block diagram showing the entire configuration of a sound processing apparatus according to an embodiment of the present invention.

An embodiment of the present invention will be hereinafter described in detail with reference to the accompanying drawings. FIG. 1 is a block diagram showing the entire configuration of a sound processing apparatus according to an embodiment of the invention. In FIG. 1, reference numeral 102 denotes a microphone; 104, an A/D converter; 106, an analyzing unit, 108, a judging unit; 110, a correcting unit; and 112, a sound data processing unit.

Operations of the above respective processing blocks will be described along a sound signal processing flow. Input sound information 101 is converted by a microphone 102 to an input analog sound signal 103, which is converted by an A/D converter 104 to input digital sound data 105. The input digital sound data 105 is supplied to the sound data processing unit 112, where it is subjected to sound data processing. As preprocessing of the sound data processing, the input digital sound data 105 is analyzed by the analyzing unit 106, so that values of a characteristic parameter 107 of the sound information is extracted. The judging unit 108 judges for significant sections and insignificant sections, and produces a judgment result 109. The judgment result 109 is input to the correcting unit 110, which corrects the judgment result, to thereby produce a corrected judgment result 111. Based on the corrected judgment result 111, the sound data processing unit 112 performs the sound data processing efficiently.

Figure 2:
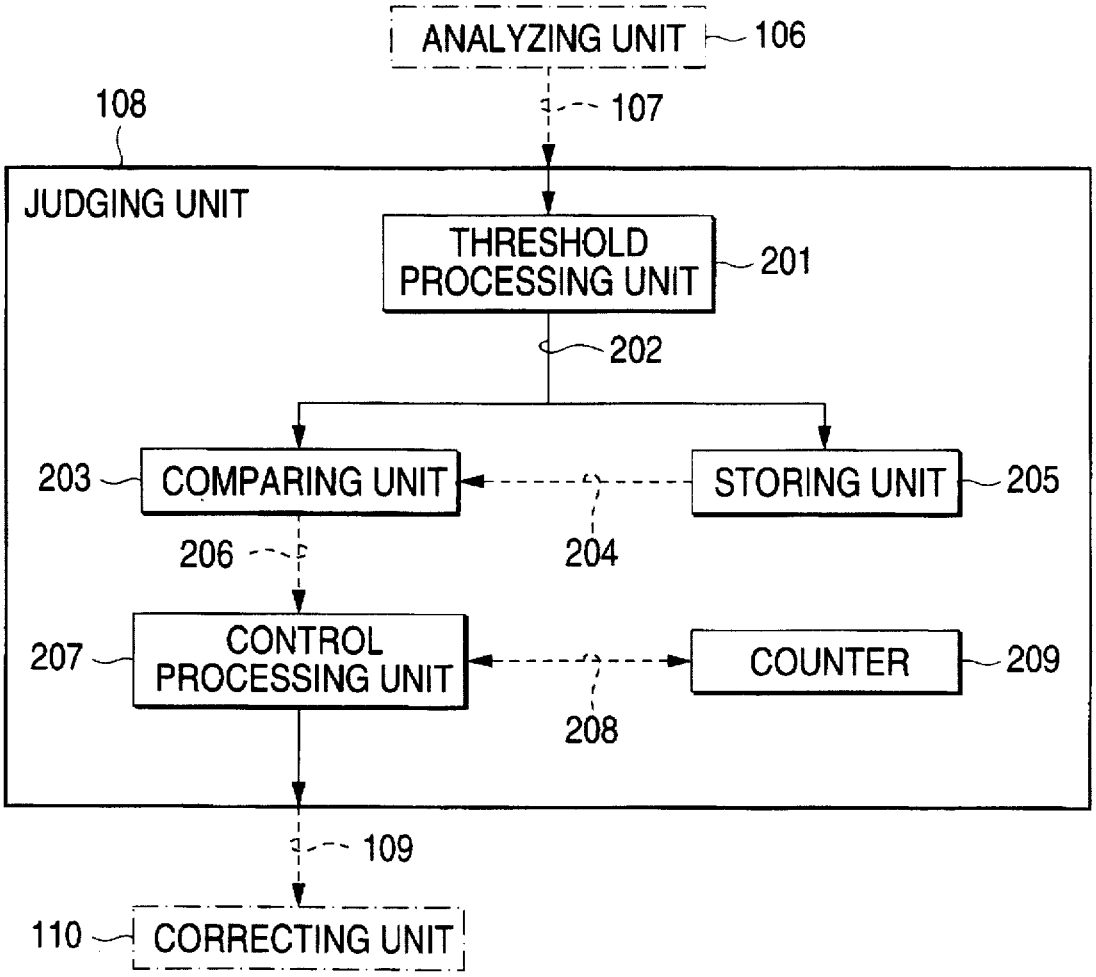
FIG. 2 is a block diagram showing a configuration of a judging unit.

A detailed description will be made of the judging unit 108. FIG. 2 is a block diagram showing a configuration of the judging unit 108. In FIG. 2, reference numeral 201 denotes a threshold processing unit; 203, a comparing unit; 205, a storing unit; 207, a control processing unit; and 209, a counter. The threshold processing unit 201 compares the characteristic parameter 107 that is supplied from the analyzing unit 106 with a predetermined value, to thereby produce a threshold processing result 202, which is input to the comparing unit 203 and the storing unit 205. The storing unit 203 temporarily stores the threshold processing result 202, and supplies, upon reception of the next threshold processing result 202, the comparing unit 203 with the stored threshold processing result as a past threshold processing result 204. The comparing unit 203 compares the current threshold processing result 202 as received from the threshold processing unit 201 with the past threshold processing result 204 stored in the storing unit 205, and supplies a comparison result 206 to the control processing unit 207. Based on the comparison result 206, the control processing unit 207 performs a judgment on a section length (length of continuation) of the same comparison result 206 while controlling the counter 209, and outputs a judgment result 109.

The operation of the judging unit 108 will further be described by way of a specific example. The threshold processing unit 201 performs the following threshold processing on the characteristic parameter 107 that has been extracted by the analyzing unit 106:

"If (para > *th*), Then (out = 1; i.e., significant)
Else (out = 0; i.e., insignificant)"

where "para" is the characteristic parameter 107, "th" is the predetermined threshold value used in the threshold processing, and "out" is the threshold processing result 202. A value "1" or "0" of the threshold processing result 202, i.e., "out" is input to the comparing unit 203 and the storing unit 205.

The comparing unit 203 compares the current threshold processing result 202 with the past threshold processing result 204, makes a judgment on a difference therebetween, and outputs the judgment result 206. Based on the judgment result 206, the control processing unit 207 processes the judgment result 206 while controlling the counter 209. More specifically, while the comparison result 206 indicates that the two threshold processing results are identical, the control processing unit 207 continues to increment the counter 209. If the comparison result 206 indicates that the two threshold processing results are different from each other, the control processing unit 207 outputs, as the judgment result 109, a count value of the counter 209 and the past threshold processing result 204 at that time.

If "significant" and "insignificant" are respectively expressed by "1" and "0" in the above judgment, the judgment result 109 that is output from the judging unit 108 is data having a format ("0" or "1", section length). The section length means a length in which the same judgment result "0" (insignificant) or "1" (significant) continues to appear. Such data are sequentially output from the judging unit 108 in a manner as exemplified below.

. . . . .
("0", 10)
("1", 70)
("0", 3)
("1", 152)

("0", 40)

. . . . .

Figure 3:
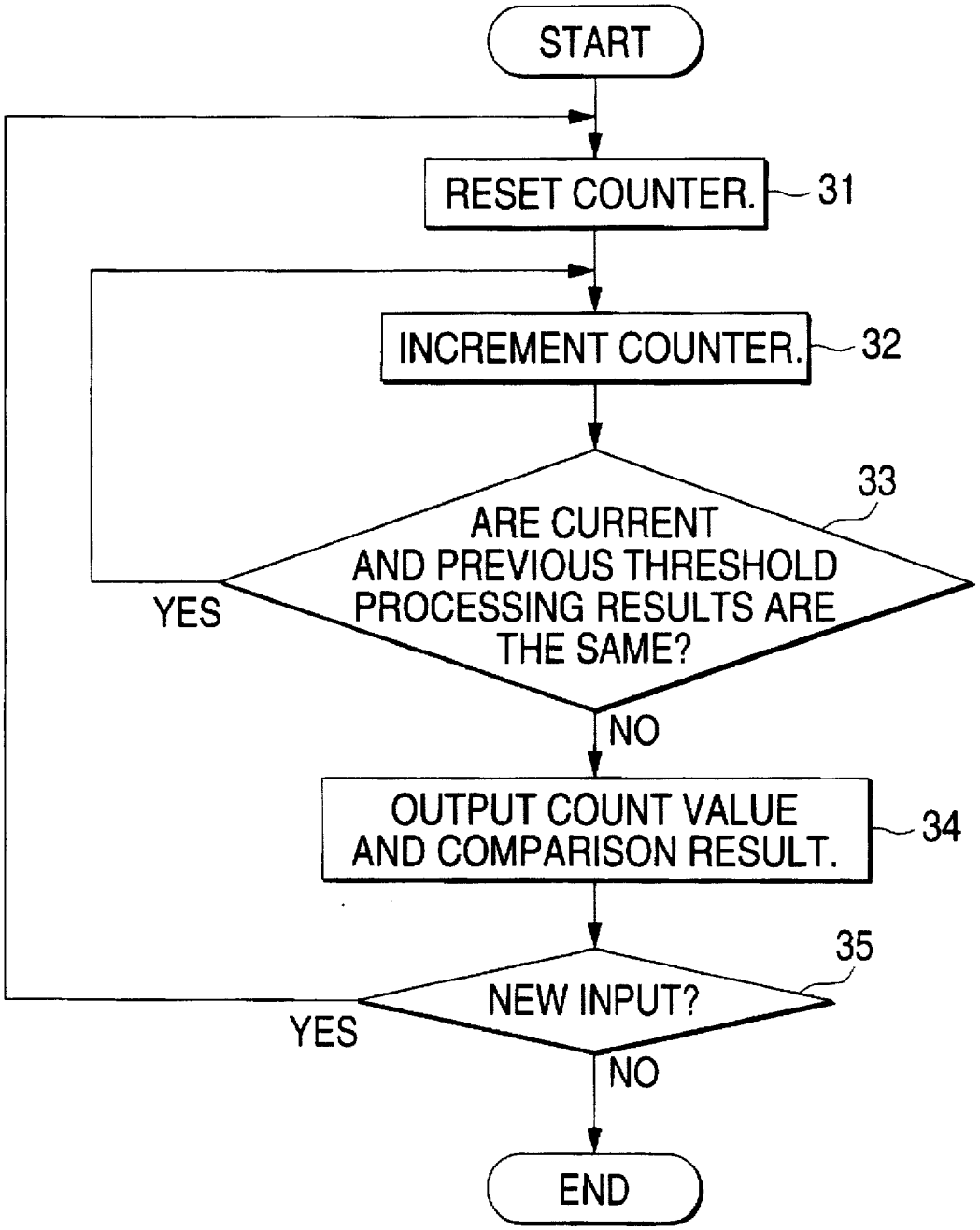
FIG. 3 is a flowchart showing an example of a series of operations performed by a comparing unit and a control processing unit of the judging unit.

FIG. 3 is a flowchart showing an example of a series of operations performed by the comparing unit 203 and the control processing unit 207 of the judging unit 108. Upon start of the processing, the counter 209 is reset in step 31, and then incremented in step 32. In step 33, it is judged whether the current threshold processing result 202 of the characteristic parameter 107 is identical to the previous threshold processing result 204 of the characteristic parameter 107. If they are identical to each other, the process returns to step 32 to increment the counter 209. If they are different from each other, the process goes to step 34, where the count value of the counter 209 and the threshold processing result of the comparing unit 203 are output. As a result, section data is output which is a set of "the threshold processing result and the length of continuation" in the above-described format. Then, in step 35, it is judged whether there exists the next input of the characteristic parameter 107. If the judgment is affirmative, the process returns to step 31, to again execute step 31 onward. If the judgment is negative, the processing is finished.

Figure 4:
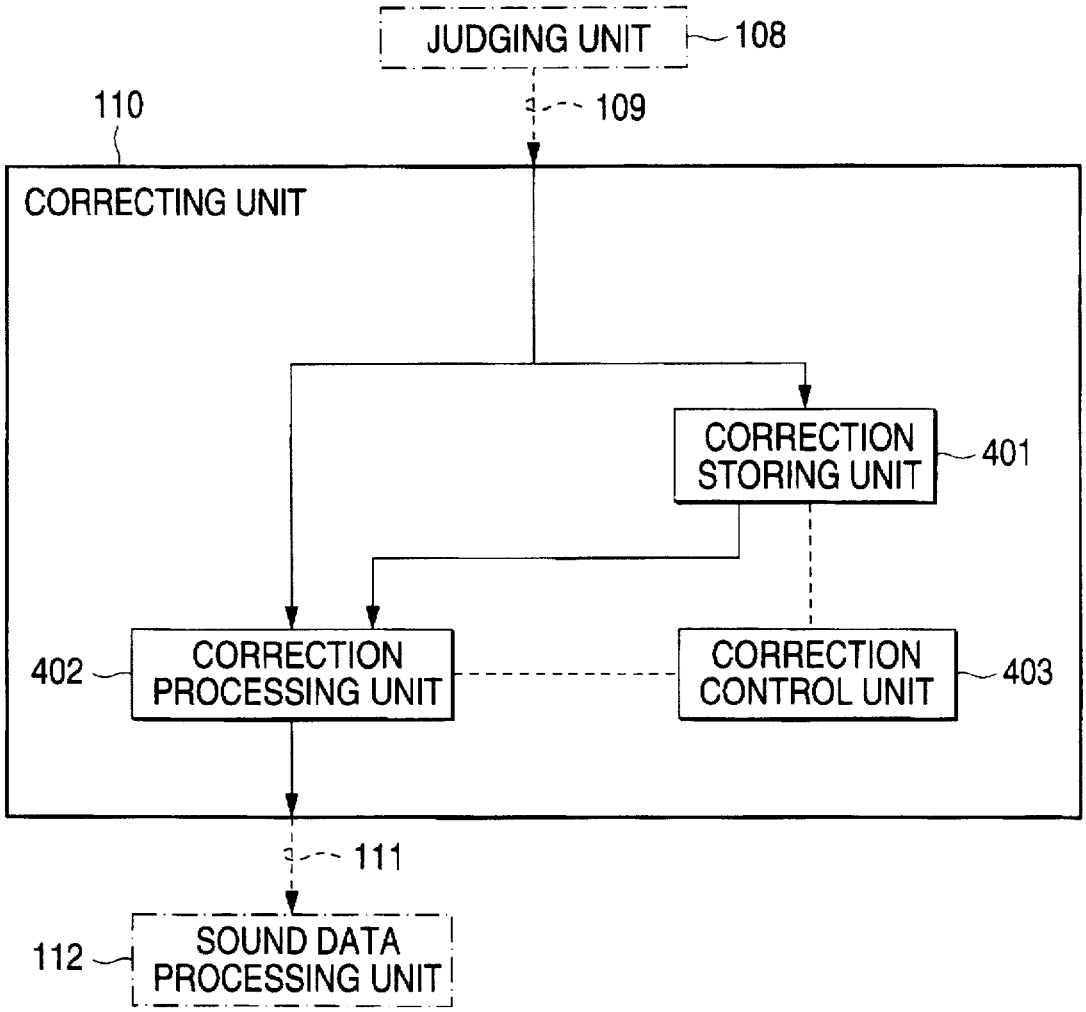
FIG. 4 is a block diagram showing an example of a configuration of a correcting section, which is the main part of the invention.
Figure 5:
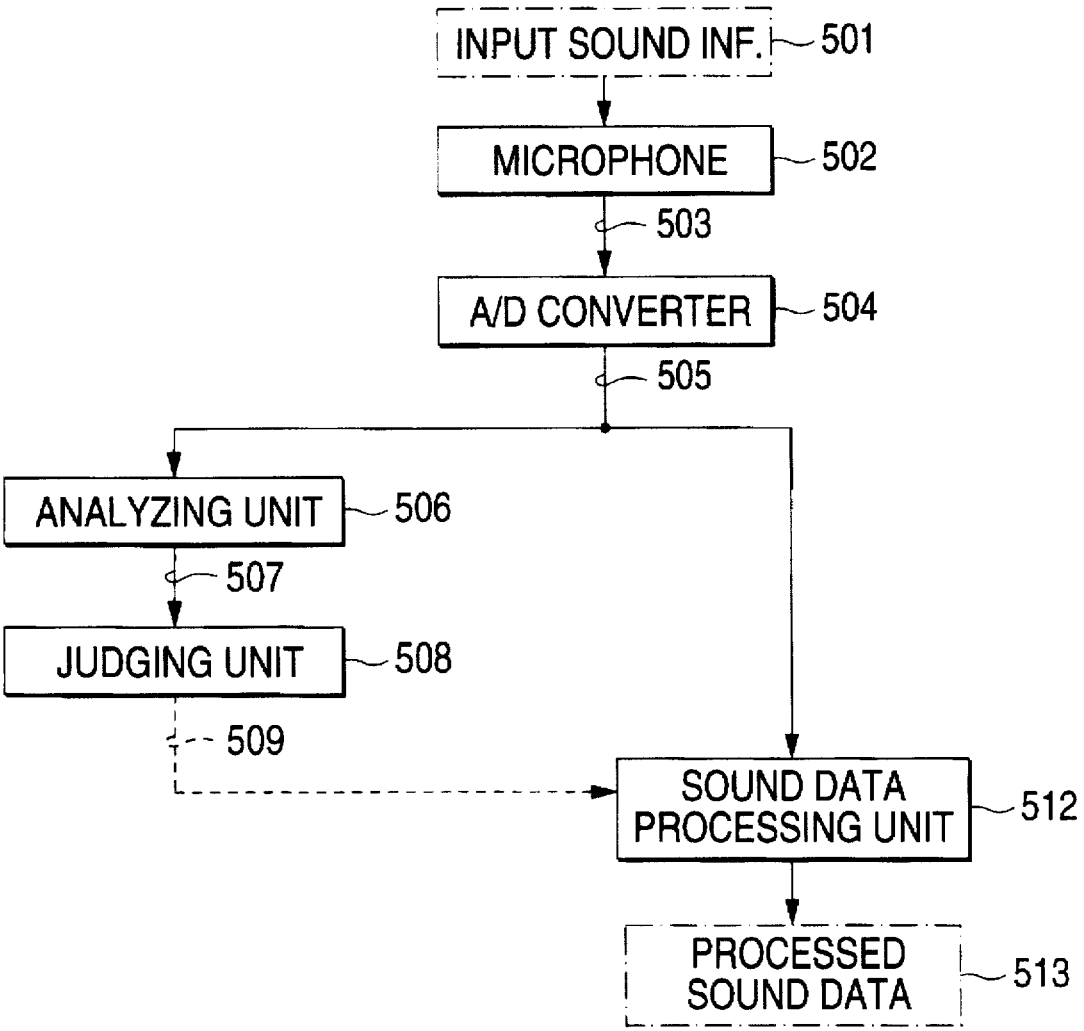
FIG. 5 PRIOR ART
FIG. 5 is a block diagram showing a configuration of a conventional sound processing apparatus.

Next, a description will be made of a configuration of the correcting unit 110. FIG. 4 is a block diagram showing an example of a configuration of the correcting unit, which is the main part of the invention. In FIG. 4, reference numeral 401 denotes a correction storing unit; 402, a correction processing unit; and 403, a correction control unit. The correction storing unit 401 temporarily stores the above-described judgment result 109 that is received from the judging unit 108. The correction processing unit 402 performs correction processing on the data (i.e., section data in the form of a set of "the threshold processing result and the length of continuation") of the judgment result 109. The correction control unit 403 controls the correction processing of the correction processing unit 403 in accordance with a correction control signal.

A description will be made of an operation of the correcting unit 110 having the above configuration. The correction processing unit 402 compares the length of continuation of the data (section data) of the judgment result 109 as received from the judging unit 108 with a predetermined value. If the length of continuation is longer than the predetermined value, the correction processing unit 402 outputs the section data as it is. On the other hand, if the length of continuation is shorter than the predetermined value, the correction processing unit 402 reverses the threshold processing result (significant or insignificant), and sums up the current continuation lengths and the continuations lengths of the immediately previous data and the next data. The correction processing unit 402 outputs the reversed threshold processing result and the summed-up continuation length as data (section data) of a single judgment result, which is a corrected judgment result 111. That is, section data having a short continuation length is corrected such that its threshold processing result is changed to that of the immediately previous data and the next section data (those two section data have the same threshold processing result (significant or insignificant), and that the section data concerned is combined with the immediately previous data and the next data to produce single section data.

For example, assume that data of a judgment result at a certain time point and data of the immediately previous and next judgment results are ("0", Lf)

("1", Lc)

("0", Ll), and the predetermined value is V. If Lc<V, the data concerned is corrected in the following manner. The threshold processing result "1" is reversed to "0" (i.e., the threshold processing result of the adjacent data) and the continuation length Lc is summed with Lf and Ll of the adjacent data. Thus, the corrected judgment result is ("0", Lf+Lc+Ll).

The above correction processing is continued until the correcting unit 110 receives no input.

In other words, among the section data each having a threshold processing result of "1" (significant) or "0" (insignificant), data having a particularly short section length (continuation length) is regarded as having an erroneous threshold processing result, and combined with data of the adjacent judgment results. In this manner, influences of noises etc. are removed to produce, for each logical block, a single section of sound data which section is judged as significant ("1") or insignificant ("0").

Figure 6:
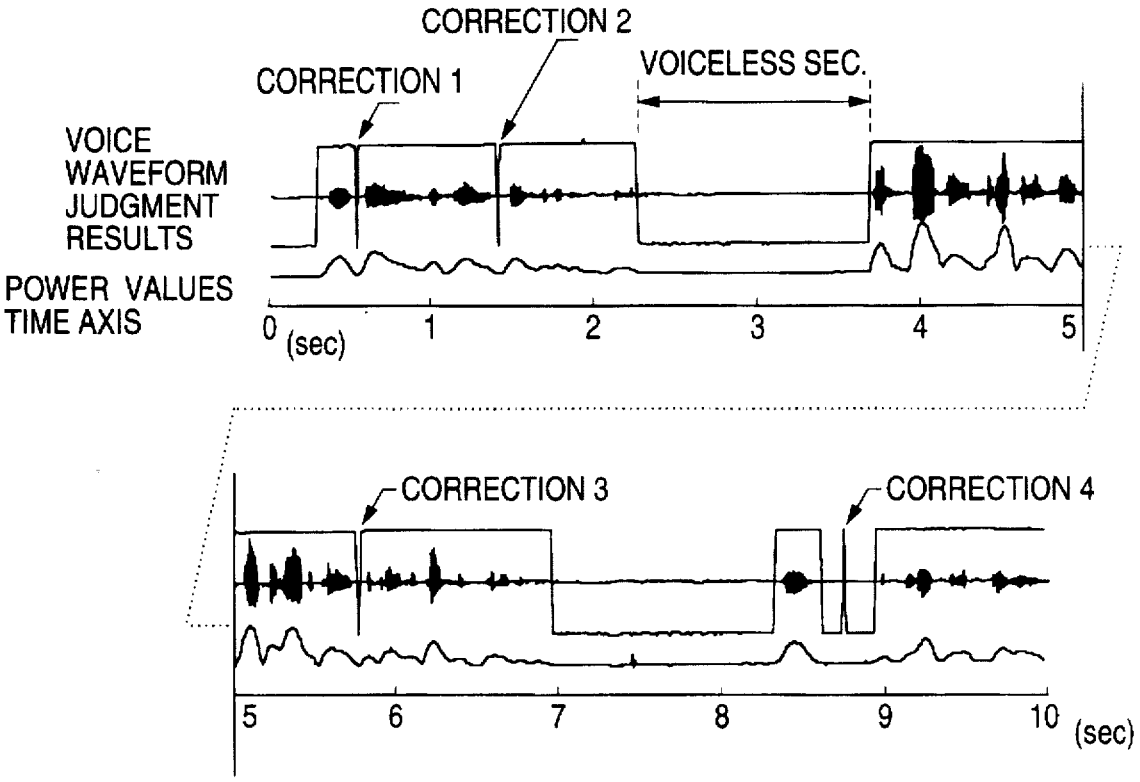
FIG. 6 is a signal waveform diagram showing an example of judgment results based on power values of a voice waveform.

FIG. 6 is a signal waveform diagram showing an example of judgment results based on power values of a voice waveform. FIG. 6 shows, with respect to the time axis, a voice waveform, a waveform of short-term power values of the voice waveform that are extracted as characteristic parameter values, and judgment results of the short-term power values obtained by the threshold processing. That is, this employs the short-term power values of the voice waveform as the characteristic parameter values to be used in judging whether respective sections are significant or insignificant in the sound signal processing. In this case, short-term power values are sequentially obtained from the voice signal, and subjected to the threshold processing in the judging unit 108, to produce judgment results.

With the judgment results produced in the above manner, as shown in FIG. 6, there exist sections (corrections 1, 2 and 3) that should be judged as significant (voiced) sections, but actually judged as insignificant (voiceless) sections because they are very short. The sections (corrections 1, 2 and 3) which should be corrected have continuation lengths that are much shorter than those of voiceless sections that are ordinarily judged as insignificant sections. Therefore, the correcting unit 110 judges for such sections, and corrects those into voiced sections.

Conversely, there exists a very short section (correction 4) that should be judged as an insignificant (voiceless) section, but is actually judged as a significant (voiced) section. Such a section should be corrected in a manner opposite to the above. Since this section (correction 4) also has a very short continuation length than the other sections, the correcting unit 110 judges for it and corrects it into a voiceless section.

Although short-term power values of a voice waveform are used as characteristic parameter values in the example of the sound signal waveform processing shown in FIG. 6, waveform parameters such as the number of zero-crossings and the autocorrelation coefficient of a voice waveform, and frequency parameters such as the LPC coefficient, cepstrum coefficient and LPC cepstrum coefficient can similarly be used as the characteristic parameter. In addition, the judgment for significant and insignificant sections by extracting characteristic parameter values may be performed after band-dividing processing by use of a filter bank at a prestage of the analyzing unit 106.

The apparatus may be so constructed that the threshold value (for the judgment on the continuation length of a section) of the correcting unit 110 may be varied in accordance with the threshold value (for judging whether a section is significant or insignificant from the characteristic parameter) of the judging unit 108. For example, the apparatus may be so constructed that the threshold value of the correcting unit 110 is increased when that of the judging unit 108 is increased. Further, a single or plural sets of combinations of optimum threshold values may be stored, and used by reading those values when necessary. This makes the correction processing suitable for each characteristic parameter.

The apparatus may be so constructed that the input digital sound data 105 is stored in a storage device (not shown) and output therefrom when necessary. The processed sound data 113 may be output from a speaker via a D/A converter (not shown), or may be stored in a storage device (not shown).

As described above, the sound processing apparatus of the invention can extract, accurately and efficiently, desired data sections from sound data, to thereby allow sound information to be reused easily. If the apparatus of the invention is used in preprocessing of speech recognition, it becomes possible to reduce the load of processing and improve the accuracy.

What is claimed is:

1. A sound processing apparatus comprising:

means for inputting a sound signal;

means for converting the input sound signal to digital sound means for extracting characteristic parameter values from the digital sound data;

means for judging a significant section and an insignificant section of the input sound signal from the extracted characteristic parameter values, and producing a judgment result indicating whether a current section is the significant or insignificant section; and means for reversing the judgment result when a continuation length of the significant or insignificant section is less than a predetermined length.

2. The sound processing apparatus of claim 1, wherein the judging means further detects the length of the significant or insignificant section, and adds information of the detected length to the judgment result.

3. The sound processing apparatus of claim 1, wherein the correcting means compares the length of the significant or insignificant section with a single or plural threshold values, and corrects the judgment result in accordance with a result of the comparison.

4. A sound processing apparatus comprising:

means for inputting a sound signal in a time-sequential manner;

means for converting the input sound signal to digital sound data;

means for extracting characteristic parameter values from the digital sound data;

means for discriminating between an extracting section and a non-extracting section of the input sound signal based on the characteristic parameter values;

means for determining continuing periods of the respective discriminated periods; and means for outputting, in a first instance, an output of the discriminating means without correcting the output when a continuing period of a particular extracting or non-extracting section is longer than a predetermined value, and for combining, in a second instance, the particular extracting or non-extracting section reversed to be non-extracting or extracting, respectively, and the sections before and after the particular extracting or non-extracting section into a single section having a period equal to a sum of the continuing period of the particular extracting or non-extracting section and continuing periods of the sections immediately before and after the particular extracting or non-extracting section when the continuing period of the particular extracting or non-extracting section is shorter than the predetermined value.

5. The sound processing apparatus of claim 4, wherein the discriminating means has a reference threshold value to be used for discriminating between the extracting section and the non-extracting section of the input sound signal, and judges that the input sound signal is in the extracting section when the characteristic parameter value is larger than the reference threshold value, and judges that the input sound signal is in the non-extracting section when the characteristic parameter value is smaller than the reference threshold value.

* * * * *

UNITED STATES PATENT AND TRADEMARK OFFICE

CERTIFICATE OF CORRECTION

PATENT NO. : 5,727,121

DATED : March 10, 1998

INVENTOR(S) : Takeshi CHIBA et al.

It is certified that error appears in the above-identified patent and that said Letters Patent is hereby corrected as shown below:

On the Title page, Item [57], in the Abstract, line 4, "judgement" should read --judgment--.

*Claim 1, column 7, line 24, after "sound", insert --data;--.

Signed and Sealed this

Eighteenth Day of May, 1999

Attest:

Q. TODD DICKINSON

Attesting Officer

Acting Commissioner of Patents and Trademarks